US008043775B2

(12) United States Patent
Miyamoto et al.

(10) Patent No.: US 8,043,775 B2
(45) Date of Patent: Oct. 25, 2011

(54) ELECTROPHOTOGRAPHIC PHOTOSENSITIVE BODY

(75) Inventors: Hideyuki Miyamoto, Chiba (JP); Takaaki Hikosaka, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 967 days.

(21) Appl. No.: 11/908,738

(22) PCT Filed: Mar. 15, 2006

(86) PCT No.: PCT/JP2006/305090

§ 371 (c)(1),
(2), (4) Date: Sep. 14, 2007

(87) PCT Pub. No.: WO2006/098351

PCT Pub. Date: Sep. 21, 2006

(65) Prior Publication Data

US 2009/0081569 A1 Mar. 26, 2009

(30) Foreign Application Priority Data

Mar. 16, 2005 (JP) ..... 2005-075975

(51) Int. Cl.
*G03G 5/14* (2006.01)

(52) U.S. Cl. ..... 430/66; 430/56

(58) Field of Classification Search ..... 430/56, 430/66

See application file for complete search history.

(56) References Cited

U.S. PATENT DOCUMENTS

| | | | | |
|---|---|---|---|---|
| 5,204,202 | A | 4/1993 | Ishikawa et al. | |
| 2001/0012594 | A1 * | 8/2001 | Ri et al. | 430/58.7 |
| 2005/0084783 | A1 * | 4/2005 | Yau et al. | 430/66 |

FOREIGN PATENT DOCUMENTS

| | | | |
|---|---|---|---|
| JP | 58181047 | A | * 10/1983 |
| JP | 2-245767 | A | 10/1990 |
| JP | 4-152352 | A | 5/1992 |
| JP | 2000-194154 | | * 7/2000 |
| JP | 2000-194154 | A | 7/2000 |
| JP | 2002-105122 | A | 4/2002 |
| JP | 2003-005417 | A | 1/2003 |
| JP | 2003-149848 | A | 5/2003 |
| JP | 2003-201345 | A | 7/2003 |
| JP | 2003-228188 | A | 8/2003 |
| JP | 2003-255581 | | * 9/2003 |
| JP | 2003-255581 | A | 9/2003 |
| JP | 2005-165146 | A | 6/2005 |

OTHER PUBLICATIONS

Machine Translation of JP 2003-255581 (Sep. 2003).*
Machine Translation of JP 2000-194154 (Jul. 2000).*
Chemical Abstracts AN 101:181109 (2010).*
Matsumoto Microspheres F-series <http://www.mtmtys.co.jp/e/product/general/data01.html> retrieved Oct. 27, 2010.*
Borsenberger, Paul et al. Organic Photoreceptors for Imaging Systems. New York: Marcel-Dekker, Inc. (1993) pp. 289-296.*
English language translation of JP58-181047 (Oct. 1983).*

* cited by examiner

*Primary Examiner* — Christopher Rodee
(74) *Attorney, Agent, or Firm* — Millen, White, Zelano & Branigan, P.C.

(57) ABSTRACT

An electrophotographic photosensitive body having a photosensitive layer on a conductive base, in which at least the outermost layer thereof contains particles having a double structure composed of a core member and a shell member having a larger rubber hardness than the core member. The electrophotographic photosensitive body has excellent mechanical strength such as wear resistance, abrasion resistance, and scratch resistance as well as excellent electrophotographic characteristics such as cleaning properties over time.

3 Claims, No Drawings

ELECTROPHOTOGRAPHIC PHOTOSENSITIVE BODY

TECHNICAL FIELD

The present invention relates to an electrophotographic photosensitive body, and more specifically, to an electrophotographic photosensitive body which: has so excellent mechanical strength and electrophotographic characteristics as to be capable of being repeatedly used for a long time period; and can be suitably utilized in a variety of electrophotographic fields.

BACKGROUND ART

Electrophotographic photosensitive bodies recently proposed and utilized are as follows: a laminated organic electrophotographic photosensitive body (OPC) in which a photosensitive layer has at least two layers, that is, a charge generating layer (CGL) that generates charge by exposure and a charge transporting layer (CTL) that transports charge, and a monolayer organic electrophotographic photosensitive body in which a photosensitive layer is composed of a single layer obtained by dispersing a charge generating substance and a charge transporting substance in a binder resin or by dispersing only a charge generating substance in a binder resin.

Further, both the laminated and monolayer electrophotographic photosensitive bodies each provided with a protective layer (OCL) for the protection of its surface layer have been utilized in view of a problem to be described later.

An organic electrophotographic photosensitive body is requested to have predetermined sensitivity, predetermined electrical characteristics, and predetermined optical characteristics in accordance with an electrophotographic process to be applied.

Electrical and mechanical external forces are applied to the surface of the photosensitive layer of the electrophotographic photosensitive body every time an operation such as corona charging or contact charging, development with toner, the transfer of toner onto paper, or a cleaning treatment is performed because the surface is repeatedly subjected to such operation.

Therefore, the photosensitive layer provided to the surface of the electrophotographic photosensitive body is requested to have durability against those external forces in order that the image quality of an electrophotograph may be maintained for a long time period.

To be specific, the photosensitive layer is requested to have durability against: the generation of wear or a flaw on its surface due to friction; and the deterioration of its surface due to an active gas such as ozone or discharge in corona charging, contact charging, or transfer.

A polycarbonate resin using, for example, 2,2-bis(4-hydroxyphenyl)propane (bisphenol A) or 1,1-bis(4-hydroxyphenyl)cyclohexane (bisphenol Z) having good compatibility with a charge transporting substance for use in a photosensitive layer and good optical characteristics as a starting material has been heretofore used as a binder resin for an organic electrophotographic photosensitive body to respond to such requests.

However, even such polycarbonate resin using bisphenol A or bisphenol Z as a raw material does not sufficiently satisfy the above requests, and a large number of methods each involving the use of a polycarbonate resin or any other resin having a structure except bisphenol A and bisphenol Z have been proposed and put into practical use.

In recent years, the surface of a photosensitive body is requested to have low surface energy, in particular, to maintain low surface energy in order that high cleaning property may be realized in association with the fact that a printing machine or copying machine employing an electrophotographic process has become possible to represent colors.

For example, an approach involving dispersing an additive for imparting hydrophobicity or fine particles each made of a material having low surface energy has been taken to respond to the above-mentioned request. However, the additive is apt to exude (bleed out) from an electrophotographic photosensitive body, and the fine particles each made of a material having low surface energy are apt to agglomerate, so the additive and the fine particles involve problems such as light scattering in the photosensitive body and insufficient dispersibility at the time of the production of the photosensitive body.

In addition, attempts such as the change of a binder resin and the addition of various additives have been made to improve the dispersibility of each of various fine particles (Patent Documents 1 and 2). However, each of the change of a binder resin and the addition of various components leads to the deterioration of the electrophotographic characteristics of an electrophotographic photosensitive body such as a reduction in sensitivity of the body, thereby causing another problem.

Patent Document 1: JP 63-65451 A
Patent Document 2: JP 05-45920 A

DISCLOSURE OF THE INVENTION

An object of the present invention is to provide an electrophotographic photosensitive body which: solves the above-mentioned problems found in a conventional electrophotographic photosensitive body; has excellent mechanical strength such as wear resistance, abrasion resistance, and scratch resistance, and excellent electrophotographic characteristics such as cleaning property for a long time period; and is excellent in practicability.

The inventors of the present invention have made extensive studies with a view to solving the above-mentioned problems. As a result, the inventors have found that the dispersion of particles each having a double structure composed of a core member and a shell member having a larger rubber hardness than that of the core member at a predetermined ratio in the surface layer of a photosensitive body can provide an electrophotographic photosensitive body which: is particularly excellent in mechanical characteristics such as scratch resistance; persistently has, in particular, electrophotographic characteristics such as a cleaning characteristic; and does not cause problems such as light scattering and the insufficient dispersion of the particles each resulting from the agglomeration of the particles. Thus, the inventors have completed the present invention.

That is, the present invention provides:

1. an electrophotographic photosensitive body having a photosensitive layer on a conductive base, the electrophotographic photosensitive body being characterized in that at least an outermost layer of the electrophotographic photosensitive body contains particles each having a double structure composed of a core member and a shell member having a larger rubber hardness than that of the core member;
2. an electrophotographic photosensitive body according to Item 1, in which the outermost layer contains the particles each having a double structure at a content of 1 to 30 mass % with respect to a total amount of a binder resin, and other functional materials or a material for a protective layer;

3. An electrophotographic photosensitive body according to Item 1 or 2, in which the particles each having a double structure have an average particle diameter of 10 μm or less;
4. an electrophotographic photosensitive body according to any one of Items 1 to 3, in which the particles each having a double structure are particles each obtained by coating a rubber spherical particle with a resin, or microcapsules each including a fluid;
5. an electrophotographic photosensitive body according to Item 4, in which a material for the rubber spherical particle is at least one kind selected from a natural rubber, a synthetic natural rubber, a styrene-butadiene rubber, a butadiene rubber, a butyl rubber, a chloroprene rubber, a nitrile rubber, an acrylic rubber, an epichlorohydrin rubber, a urethane rubber, a polysulfide rubber, a fluoro rubber, at least one kind of a rubber-like polymer obtained from a monomer mainly composed of an alkyl acrylate, an alkyl methacrylate, or dimethylsiloxane, and a silicone rubber, and the resin is at least one kind selected from a polystyrene resin, a polyvinyl chloride resin, a polyvinyl acetate resin, a vinyl chloride-vinyl acetate copolymer, a polyvinyl acetal resin, an alkyd resin, an acrylic resin, a polyacrylonitrile resin, a polycarbonate resin, a polyamide resin, a butyral resin, a polyester resin, a vinylidene chloride-vinyl chloride copolymer, a methacrylic resin, a styrene-butadiene copolymer, a vinylidene chloride-acrylonitrile copolymer, a vinyl acetate resin, a vinyl chloride-vinyl acetate-maleic anhydride copolymer, a silicone-alkyd resin, a phenol-formaldehyde resin, a styrene-alkyd resin, a melamine resin, a polyether resin, a benzoguanamine resin, an epoxy acrylate resin, a urethane acrylate resin, a poly-N-vinylcarbazole resin, a polyvinyl butyral resin, a polyvinyl formal resin, a polysulfone resin, casein, gelatin, a polyvinyl alcohol resin, ethylcellulose, nitrocellulose, carboxy-methylcellulose, a vinylidene chloride-based polymer latex, an acrylonitrile-butadiene copolymer, a vinyl toluene-styrene copolymer, a soybean oil-modified alkyd resin, a polystyrene nitrate resin, a polymethylstyrene resin, a polyisopreneresin, apolythiocarbonateresin, apolyallylateresin, a polyhaloallylate resin, a polyallylether resin, a polyvinyl acrylate resin, a polyester acrylate resin, and a silicone resin;
6. an electrophotographic photosensitive body according to Item 5, in which the rubber spherical particle is made of a silicone rubber, and the resin is a silicone resin;
7. an electrophotographic photosensitive body according to Item 4, in which the fluid is at least one kind selected from a mineral oil, a polyolefin, a polyalkylene glycol, a monoester, a diester, a polyol ester, a phosphate, a silicate, polyphenyl ether, a perfluoroalkyl ether, a fluorine-based oil, a silicone oil, a silicone gel, and water, and a shell member of each of the microcapsules is at least one kind selected from gum arabic, gelatin, collagen, casein, polyamino acid, agar, sodium alginate, carrageenan, konjakmannan, a dextran sulfate, ethylcellulose, nitrocellulose, carboxymethylcellulose, acetylcellulose, a formalin naphthalenesulfonate condensate, a polyamide resin, a polyurethane resin, a polyester resin, a polycarbonate resin, an alkyd resin, an amino resin, a silicone resin, a maleic anhydride-based copolymer, an acrylic acid-based copolymer, a methacrylic copolymer, a polyvinyl chloride resin, a polyvinylidene chloride resin, a polyethylene resin, a polystyrene resin, a polyvinyl acetal resin, a polyacrylamide resin, polyvinylbenzene sulfonate, a polyvinyl alcohol resin, a urea-formaldehyde resin, and a melamine-formaldehyde resin; and
8. an electrophotographic photosensitive body according to Item 7, in which the fluid is a mineral oil, and the shell member of each of the microcapsules is a melamine-formaldehyde resin.

BEST MODE FOR CARRYING OUT THE INVENTION

The present invention relates to an electrophotographic photosensitive body having a photosensitive layer on a conductive base, the electrophotographic photosensitive body being characterized in that at least the outermost layer of the electrophotographic photosensitive body contains particles each having a double structure composed of a core member and a shell member having a larger rubber hardness than that of the core member.

An electrophotographic photosensitive body of the present invention is an electrophotographic photosensitive body having a photosensitive layer on a conductive base. The structure of the electrophotographic photosensitive body is not particularly limited as long as the photosensitive layer is formed on the conductive base; the electrophotographic photosensitive body may be any one of the electrophotographic photosensitive bodies of all types including, naturally, various electrophotographic photosensitive bodies such as monolayer and laminated electrophotographic photosensitive bodies.

A monolayer electrophotographic photosensitive body of the present invention is preferably such that its photosensitive layer has at least a charge generating substance and a charge transporting substance (at least one kind of a substance chosen from a hole transporting substance and an electron transporting substance).

A laminated electrophotographic photosensitive body of the present invention is preferably such that its photosensitive layer has at least one charge generating layer and at least one charge transporting layer of which a surface layer is formed.

The outermost layer of the electrophotographic photosensitive body in the present invention is as follows: when the body is structured to have a protective layer, the protective layer is the outermost layer, and, when the body is structured not to have any protective layer, a charge transporting layer or a photosensitive layer composed of a single layer is the outermost layer.

When the body has a protective layer, the particles each having a double structure may be incorporated into only the protective layer, or may be incorporated into, for example, a charge transporting layer inside the protective layer as well as the protective layer.

The content of the particles each having a double structure composed of a core member and a shell member having a larger rubber hardness than that of the core member is preferably 1 to 30 mass %, more preferably 3 to 20 mass %, or still more preferably 3 to 10 mass % with respect to the total amount of a binder resin, and the other functional materials [a charge moving substance (hole moving substance or an electron moving substance) and a charge generating substance] or a material for a protective layer.

When the content of the particles each having a double structure is 1 mass % or more, the mechanical strength of the photosensitive body such as wear resistance is improved, and such low surface energy (low coefficient of friction) that the body can realize high cleaning property even after the body has been repeatedly used is maintained. When the content is 30 mass % or less, the extent to which the light transmittance of the body reduces does not affect the practicability of the body, and the body can sufficiently function as an electrophotographic photosensitive body.

The particles each having a double structure of the present invention have an average particle diameter of preferably 10 μm or less, more preferably 7 μm or less, still more preferably 5 μm or less, or most preferably 1 μm.

Examples of the particles each having a double structure composed of a core member and a shell member having a larger rubber hardness than that of the core member of the present invention include particles each obtained by coating a rubber spherical particle with a resin, and microcapsules each including a fluid.

The particles each obtained by coating a rubber spherical particle with a resin of the present invention are particles each obtained by coating the rubber spherical particle with a thin layer of the resin.

The resin has a rubber hardness of preferably more than Shore A50, more preferably Shore A70 or more, or still more preferably Shore A100 or more.

It should be noted that a material for the resin may be a resin that does not show elasticity at room temperature.

When the rubber hardness of the resin exceeds Shore A50, the dispersibility of each of the particles is improved.

The rubber spherical particle has a rubber hardness of preferably Shore A50 or less, more preferably Shore A40 or less, or still more preferably Shore A30 or less.

When the rubber spherical particle has a rubber hardness of Shore A50 or less, the mechanical strength of the photosensitive body such as wear resistance is improved, and the coefficient of dynamic friction of the body after wear can be reduced.

In addition, the shell member of each of the microcapsules of the present invention has a rubber hardness of preferably more than Shore A50, more preferably Shore A70 or more, or still more preferably Shore A100 or more.

A material for the shell member of each of the microcapsules may be a resin that does not show elasticity at room temperature.

When the rubber hardness of the shell member of each of the microcapsules exceeds Shore A50, the dispersibility of each of the particles is improved, and the mechanical strength of the photosensitive body such as wear resistance is improved.

It should be noted that the term "rubber hardness" refers to a value for a material identical to each of the core member and the shell member, the material being turned into a sheet by, for example, hot pressing, measured with a type A durometer.

Examples of a material for the rubber spherical particle in each of the particles each obtained by coating the rubber spherical particle with a resin of the present invention include: a natural rubber; a synthetic natural rubber; a styrene-butadiene rubber; a butadiene rubber; a butyl rubber; a chloroprene rubber; a nitrile rubber; an acrylic rubber; an epichlorohydrin rubber; a urethane rubber; a polysulfide rubber; a fluoro rubber; at least one kind of a rubber-like polymer obtained from a monomer mainly composed of an alkyl acrylate, an alkyl methacrylate, or dimethylsiloxane; and a silicone rubber.

Specific examples of the resin include a polystyrene resin, a polyvinylchloride resin, a polyvinylacetate resin, a vinylchloride-vinylacetate copolymer, a polyvinylacetal resin, an alkyd resin, an acryl resin, a polyacrylonitrile resin, a polycarbonate resin, a polyamide resin, a butylal resin, a polyester resin, a vinylidenechloride-vinylchloride copolymer, a methacryl resin, a styrene-butadiene copolymer, a vinylidenechloride-acrylonitrile copolymer, a vinyl acetate resin, a vinylchloride-vinylacetate-maleic anhydride copolymer, a silicone-alkyd resin, a phenol-formaldehyde resin, a styrene-alkyd resin, a melamine resin, a polyether resin, a benzoguanamine resin, an epoxyacrylate resin, a urethaneacrylate resin, a poly-N-vinylcarbazole resin, a polyvinylbutylal resin, a polyvinylformal resin, a polysulfone resin, casein, gelatin, a polyvinyl alcohol resin, ethylcellulose, nitrocellulose, carboxy-methyl cellulose, vinylidenechloride-based polymer latex, an acrylonitrile-butadiene copolymer, a vinyltoluene-styrene copolymer, a soybean oil-modified alkyd resin, a nitrated polystyrene resin, apolymethylstyrene resin, apolyisoprene resin, a polythiocarbonate resin, a polyarylate resin, a polyhaloarylate resin, a polyaryl ether resin, a polyvinylacrylate resin, polyesteracrylate resin, and a silicone resin.

A method of producing the particles each obtained by coating a rubber spherical particle with a resin of the present invention is not particularly limited, and a known method is adopted.

A core-shell type and graft rubber-like elastic body can be preferably used in each of the particles each obtained by coating a rubber spherical particle with a resin of the present invention.

The core-shell type and graft rubber-like elastic body has a two-layered structure constituted of a core and a shell.

The core portion is in a soft rubber state, the shell portion on the surface of the core portion is in a hard resin state, and the rubber-like elastic body itself is a graft rubber-like elastic body in a powder state (particle state).

For example, a product obtained by polymerizing at least one kind of a vinyl-based monomer such as styrene in the presence of at least one kind of a rubber-like polymer obtained from a monomer mainly composed of an alkyl acrylate, an alkyl methacrylate, or dimethylsiloxane is preferably used as the core-shell type and graft rubber-like elastic body.

Alternatively, a product obtained by polymerizing or copolymerizing, for example, an aromatic vinyl compound such as styrene or α-methylstyrene, an acrylate such as methyl acrylate or ethyl acrylate, or a methacrylate such as methyl methacrylate or ethyl methacrylate in the presence of a rubber-like polymer may also be used.

Examples of a core shell-type and graft rubber-like elastic body include a butadiene-acrylonitrile-styrene-core shell rubber (ABS), a methylmethacrylate-butadiene-styrene-core shell rubber (MBS), a methylmethacrylate-butylacrylate-styrene-core shell rubber (MAS), an octylacrylate-butadiene-styrene-core shell rubber (MABS), an alkylacrylate-butadiene-acrylonitrile-styrene-core shell rubber (AABS), a butadiene-styrene-core shell rubber (SBR), and a core shell rubber containing siloxane, such as methylmethacrylate-butylacrylate-siloxane.

Examples of a commercially available core-shell type and graft rubber-like elastic body include: a Hiblene B621 (manufactured by ZEON CORPORATION); a KM-357P (manufactured by KUREHA CORPORATION); a Metablen W529, a Metablen S2001, a Metablen C223, and a Metablen B621 (each manufactured by Mitsubishi Rayon Co., Ltd.); and a KM-330 (manufactured by Rohm & Haas Company).

The particles each obtained by coating a rubber spherical particle with a resin of the present invention are preferably particles each obtained by coating a silicone rubber spherical particle with a silicone resin.

That is, the rubber spherical particle is preferably made of a silicone rubber, and the resin is preferably a silicone resin.

An example of the silicone rubber is a spherical silicone cured product having rubber elasticity and a linear organopolysiloxane block represented by a general formula (1):

$$—(R^1{}_2SiO)_n— \quad (1)$$

where $R^1$'s represent one or more kinds of monovalent organic groups each having 1 to 20 carbon atoms and each selected from an alkyl group, an aryl group, an alkenyl group, a monovalent halogenated hydrocarbon group, and a reactive group-containing organic group, and 90 mol % or more of $R^1$'s preferably represent methyl groups, and n represents a number of 2,500 to 120,000, or preferably 5,000 to 10,000.

Examples of the alkyl group include a methyl group, an ethyl group, a propyl group, and a butyl group.

Examples of the aryl group include a phenyl group and a tolyl group.

Examples of the alkenyl group include a vinyl group and an allyl group.

Examples of the aralkyl group include β-phenylethyl group and a β-phenylpropyl group.

Examples of the monovalent halogenated hydrocarbon group include a chloromethyl group and a 3,3,3-trifluoropropyl group.

Examples of the reactive group-containing organic group include organic groups each containing a reactive group such as an epoxy group, an amino group, a mercapto group, an acryloxy group, and a methacryloxy group.

In addition, the silicone rubber spherical fine particles may each contain, for example, silicone oil, organosilane, an inorganic powder, or an organic powder, and have an average particle diameter of 0.1 to 10 μm, preferably 0.1 to 7 μm, or more preferably 0.1 to 5 μm.

A preferable method of producing the silicone rubber spherical fine particles involves: subjecting (a) a vinyl group-containing organopolysiloxane and (b) an organohydrogen polysiloxane to an addition reaction in the presence of (c) a platinum-based catalyst; and curing the resultant to provide a composition.

The component (a) must have at least two vinyl groups bonded to a silicon atom in any one of its molecules. The vinyl groups may be present at any sites in the molecule; at least a terminal of the molecule preferably has a vinyl group.

Organic groups bonded to silicon atoms except a vinyl group are each selected from monovalent organic groups similar to those described above for $R^1$, and 90 mol % or more of the groups preferably represent methyl groups.

In addition, the molecular structure of the component may be a linear structure, a branched structure, or the mixture of those structures, and the molecular weight of the component is not particularly limited; the component preferably has a viscosity at 25° C. of 0.001 Pa·s (1 cP) or more in order that the cured product may be a rubber-like elastic body.

An example of the silicone resin is a resin-like polymer having as a constituent unit an organosilsesquioxane unit represented by a general formula (2):

$$R^2{}_2SiO_{3/2} \quad (2)$$

where $R^2$s represent one or more kinds of monovalent organic groups each having 1 to 20 carbon atoms and each selected from an alkyl group, an aryl group, an alkenyl group, an aralkyl group, a monovalent halogenated hydrocarbon group, and a reactive group-containing organic group.

Examples of the alkyl group include a methyl group, an ethyl group, a propyl group, and a butyl group.

Examples of the aryl group include a phenyl group and a tolyl group.

Examples of the alkenyl group include a vinyl group and an allyl group.

Examples of the aralkyl group include β-phenylethyl group and β-phenylpropyl group.

Examples of the monovalent halogenated hydrocarbon group include a chloromethyl group and a 3,3,3-trifluoropropyl group.

Examples of the reactive group-containing organic group include organic groups each containing a reactive group such as an epoxy group, an amino group, a mercapto group, an acryloxy group, and a methacryloxy group.

Fifty mol percent or more of $R^2$'s described above preferably represent methyl groups, and, in addition to the above $R^2SiO_{3/2}$ unit, a small amount of an $R^2{}_2SiO_{2/2}$ unit, $R^2{}_3SiO_{1/2}$ unit, or $SiO_2$ unit may be incorporated into the silicone resin to such an extent that the coating property of the silicone resin is not impaired.

The entire surface of each silicone rubber spherical fine particle may be uniformly coated with a polyorganosilsesquioxane resin, or part of the surface may be coated with the resin. The amount of the polyorganosilsesquioxane resin to be used is 1 to 500 parts by mass with respect to 100 parts by mass of the silicone rubber spherical fine particles.

A method of producing the particles each obtained by coating a silicone rubber spherical particle with a silicone resin of the present invention involves: adding an alkaline substance or an alkaline aqueous solution, and an organotrialkoxysilane to a water dispersion of silicone rubber spherical fine particles having an average particle diameter of 0.1 to 10 μm; and subjecting the resultant to hydrolysis and a condensation reaction to provide the particles.

The alkaline substance or the alkaline aqueous solution has a pH in the range of 10.0 to 13.0.

Examples of the alkaline substance include: alkali metal hydroxides such as sodium hydroxide; alkaline earth metal hydroxides such as calcium hydroxide; alkali metal carbonates such as sodium carbonate; amines such as ammonia, monomethylamine, and dimethylamine; and quaternary ammonium hydroxides such as tetramethylammonium hydroxide.

An example of the organotrialkoxysilane is a silane compound represented by a general formula (3):

$$R^2Si(OR^3)_3 \quad (3)$$

where $R^3$ represents an alkyl group having 1 to 6 carbon atoms, and $R^2$ has the same meaning as that described above.

Examples of the alkyl group having 1 to 6 carbon atoms include a methyl group, an ethyl group, a propyl group, and a butyl group.

Specific examples of organotrialkoxysilane include methyltrimethoxysilane, N-(β-aminoethyl)-γ-aminopropyltrimthoxysilane, γ-glycycloxypropyltrimethoxysilane, vinyltrimethoxysilane, phenyltrimethoxysilane, γ-methacryloxypropyltrimethoxysilane, γ-mercaptopropyltrimethoxysilane, and 3,3,3-trifluoropropyltrimethoxysilane.

Fifty mol percent or more of the molecules of the organotrialkoxysilane are particularly preferably methyltrimethoxysilane molecules.

Examples of a commercially available product for the particles each obtained by coating a silicone rubber spherical particle with a silicone resin of the present invention include a KMP-600, a KMP-605, and an X-52-7030 (each manufactured by Shin-Etsu Chemical Co., Ltd., silicone composite powders) (each having an average particle diameter of 0.8 to 5 μm and a core hardness of 30 to 75).

Next, the microcapsules of the present invention each include a fluid.

The term "fluid" refers to a substance having fluidity such as a liquid or a gel.

The fluid has a dynamic viscosity at 25° C. of 100 to 100,000 $mm^2/s$, or preferably 1,000 to 500,000 $mm^2/s$.

Examples of the fluid to be included in each microcapsule include a mineral oil or synthetic oils such as a polyolefin, a polyalkylene glycol, a monoester, a diester, a polyol ester, a phosphate, a silicate, polyphenyl ether, a perfluoroalkyl ether, a fluorine-based oil, and a silicone oil. The examples further include a silicone gel and water.

Examples of the mineral oil include a distillate oil obtained by distilling a paraffin base crude oil, an intermediate base crude oil, or a naphthene base crude oil under normal pressure or by distilling an oil remaining after the distillation of such oil under normal pressure under reduced pressure, and a refined oil obtained by refining the distillate oil in accordance with an ordinary method such as a solvent refined oil, a hydrogenation refined oil, a dewaxed refined oil, or a clay treatment oil.

Examples of polyolefine include poly(α-olefine) having 8 to 14 carbon atoms and polybutene.

An example of a polyalkylene glycol includes polypropylene glycol.

Examples of monoester include n-butyl oleate, 2-ethylhexyl oleate, 2-ethylhexyl stearate, 2-ethylhexyl palmeate, and butoxyethyl oleate.

Examples of diester include dioctyl adipate, diisononyl adipate, diisodecyl adipate, di-2-ethylhexyl azelate, diisooctyl azelate, isononyl azelate, di-2-ethylhexyl sebacate, diisooctyl sebacate, diisononyl sebacate, and 2-ethylhexyl dodecanedioic acid.

Examples of polyolester include ester composed of neopentyl glycol and carboxylic acid having 8 to 10 carbon atoms, and ester composed of trimethylolpropane and carboxylic acid having 8 to 10 carbon atoms.

Examples of phosphate include tricresyl phosphate and propyldiphenyl phosphate.

Examples of silicate include tetraoctyl silicate and tetradecyl silicate.

Examples of polyether include polyphenyl ether and 1,3-bis(m-phenoxyphenoxy)benzene.

An example of the perfluoroalkyl ether is a polymer represented by a general formula (4):

$$C_xF_{2x+1}—[O—CF(CF_3)—CF_2]_n—(O—CF_2)_m—O— \quad (4)$$

where x represents 1, 2, or 3, and n/m is larger than 40.

Examples of the fluorine-based oil include polymers each represented by a general formula (5) or (6).

$$—(CF_2—CF_2—CF_2—O—)_n— \quad (5)$$

$$—[CF(CF_3)—CF_2—O—]_n— \quad (6)$$

An example of the silicone oil is a silicone oil represented by a general formula (7):

$$—(R^4R^5SiO)— \quad (7)$$

where $R^4$ and $R^5$ represent one or more kinds of monovalent organic groups each having 1 to 20 carbon atoms and each selected from an alkyl group, an aryl group, an alkenyl group, an aralkyl group, a monovalent halogenated hydrocarbon group, and a reactive group-containing organic group, and n represents a number of 5 to 5,000, or preferably 20 to 1,500.

Examples of the alkyl group include a methyl group, an ethyl group, a propyl group, and a butyl group.

Examples of the aryl group include a phenyl group and a tolyl group.

Examples of the alkenyl group include a vinyl group and an allyl group.

Examples of the aralkyl group include a benzyl group, β-phenylethyl group, and a γ-phenylpropyl group.

Examples of the monovalent halogenated hydrocarbon group include a chloromethyl group and a 3,3,3-trifluoropropyl group.

Examples of the reactive group-containing organic group include organic groups each containing a reactive group such as an epoxy group, an amino group, a mercapto group, an acryloxy group, and a methacryloxy group.

Specific examples of the silicone oil include a dimethyl silicone oil, a methylphenyl silicone oil, an alkyl-modified silicone oil, an amino-modified silicone oil, an aliphatic acid-modified silicone oil, an epoxy-modified silicone oil, and a fluorosilicone oil.

In the present invention, one kind of a fluid may be used, or two or more kinds of fluids may be used in combination.

Of the fluids, a mineral oil and a silicone oil are preferable, and the silicone oil is preferably a dimethyl silicone oil.

The capsule shell member of each of the microcapsules to be used in the present invention is insoluble in the fluid to be included in the microcapsule, and is not broken under the use conditions of the electrophotographic photosensitive body.

In addition, the capsule shell member of each of the microcapsules may be a material through which the fluid does not easily transmit, or may be a material through which the fluid gradually transmits.

An example of the capsule shell member of each of the microcapsules is a film formable polymer substance.

A conventionally known product can be used as the film formable polymer substance, and examples of such product include gum arabic, gelatin, collagen, casein, polyamino acid, agar, sodium alginate, carrageenan, konjakmannan, a dextran sulfate, ethylcellulose, nitrocellulose, carboxymethylcellulose, acetylcellulose, a formalin naphthalenesulfonate condensate, a polyamide resin, a polyurethane resin, a polyester resin, a polycarbonate resin, an alkyd resin, an amino resin, a silicone resin, a maleic anhydride-based copolymer, an acrylic acid-based copolymer, a methacrylic copolymer, a polyvinylchloride resin, a polyvinylidene chloride resin, a polyethylene resin, a polystyrene resin, a polyvinyl acetal resin, a polyacrylamide resin, polyvinylbenzene sulfonate, a polyvinyl alcohol resin, a urea-formaldehyde resin, and a melamine-formaldehyde resin.

Of those, a melamine-formaldehyde resin is preferable.

One kind of the above-mentioned microcapsule shell members can be used alone, or two or more kinds of them can be used as a mixture.

Examples of a method of producing the microcapsules include known microcapsule methods such as a complex coacervation method, a simple coacervation method, a salt coacervation method, a method for phase separation from a water-soluble or aqueous dispersion such as the insolubilization of a polymer based on a pH change, the change of a solvent, or the removal of the solvent, an interfacial polymerization method, and an In Situ polymerization method.

A method of producing a microcapsule using a melamine-formaldehyde resin as its capsule shell member is, for example, the following method.

A fluid is emulsified and dispersed in a liquid vehicle continuous phase of, for example, an ethylene-maleic anhydride copolymer, and then the primary resin coating film of a melamine-formaldehyde resin is deposited on an interface between the phase and the fluid, whereby microcapsule slurry containing microcapsules suspended in a dispersion medium is obtained.

Next, the microcapsule slurry is slowly cooled to room temperature, and its pH is slightly adjusted toward values lower than 7. After that, a melamine-formaldehyde resin is added as a resin for a secondary coating film to the system so that a needle-like resin fine piece is precipitated in the liquid vehicle continuous phase. After that, the needle-like resin fine piece is fixed as a secondary resin coating film on the microcapsule primary resin coating film, whereby a fine particle microcapsule is formed.

However, instead of distinguishing the primary and secondary resin coating films from each other, one can form a capsule by: reducing the pH of the microcapsule slurry during an ordinary step of forming a microcapsule coating film to increase the frequency of a resinification reaction for the slurry abnormally so that a free needle-like resin piece is precipitated in a vehicle; and subsequently returning the pH to a value appropriate for the formation of a capsule coating film to cause a film to capture the needle-like resin piece simultaneously with the formation of the film.

Any one of various conductive bases can be used as the conductive substrate for use in the electrophotographic photosensitive body of the present invention, and specific examples of a conductive base that can be used include: a plate, drum, or sheet composed of aluminum, nickel, chromium, palladium, titanium, molybdenum, indium, gold, platinum, silver, copper, zinc, brass, stainless steel, lead oxide, tin oxide, indium oxide, ITO, or graphite; a glass, cloth, paper, or plastic film, sheet, or seamless belt subjected to a conductive treatment by coating with a conductive material using, for example, vapor deposition, sputtering, or application; and a metal drum subjected to a metal oxidation treatment using, for example, electrode oxidation.

The charge generating layer of a laminated electrophotographic photosensitive body contains at least a charge generating substance, and the charge generating layer can be formed by: forming a layer of the charge generating substance on a base as a ground for the charge generating layer by a vacuum vapor deposition method, a chemical vapor deposition method, or a sputtering method; or binding the charge generating substance onto a layer as a ground for the charge generating layer with a binder resin.

Any one of various methods can be employed as a method of forming the charge generating layer involving the use of a binder resin; in ordinary cases, for example, a method involving applying an application liquid prepared by dispersing or dissolving the charge generating substance and the binder resin in a proper solvent onto a predetermined layer as a ground and drying the applied liquid is suitably employed.

The charge generating layer thus obtained has a thickness of 0.01 to 2.0 μm, or preferably 0.1 to 0.8 μm.

When the thickness of the charge generating layer is 0.01 μm or more, a layer having a uniform thickness can be easily formed. In addition, when the thickness is 2.0 μm or less, the electrophotographic characteristics of the electrophotographic photosensitive body are improved.

Any one of various materials can be used as a charge generating material in the above charge generating layer.

Specific compounds include: selenium elementary substances such as amorphous selenium and trigonal selenium; selenium alloys such as a selenium-tellurium alloy; selenium compounds such as $As_2Se_3$ or selenium-containing compositions; inorganic materials each composed of elements belonging to Groups 12 and 16 such as zinc oxide and CdSSe; oxide-based semiconductors such as titanium oxide; silicon-based materials such as amorphous silicon; metal-free phthalocyanine pigments such as τ-type metal-free phthalocyanine and χ-type metal-free phthalocyanine; metal phthalocyanine pigments such as α-type copper phthalocyanine, β-type copper phthalocyanine, γ-type copper phthalocyanine, ϵ-type copper phthalocyanine, X-type copper phthalocyanine, A-type titanyl phthalocyanine, B-type titanyl phthalocyanine, C-type titanyl phthalocyanine, D-type titanyl phthalocyanine, E-type titanyl phthalocyanine, F-type titanyl phthalocyanine, G-type titanyl phthalocyanine, H-type titanyl phthalocyanine, K-type titanyl phthalocyanine, L-type titanyl phthalocyanine, M-type titanyl phthalocyanine, N-type titanyl phthalocyanine, Y-type titanyl phthalocyanine, oxotitanyl phthalocyanine, and titanyl phthalocyanine showing a strong diffraction peak at a Bragg angle 2θ in an X-ray diffraction pattern of 27.3±0.2°; a cyanine dye; an anthracene pigment; a bisazo pigment; a pyrene pigment; a polycyclic quinone pigment; a quinacridone pigment; an indigo pigment; a perylene pigment; a pyrylium dye; a squarylium pigment; an anthanthrone pigment; a benzimidazole pigment; an azo pigment; a thioindigo pigment; a quinoline pigment; a lake pigment; an oxazine pigment; a dioxazine pigment; a triphenylmethane pigment; an azlenium dye; a triarylmethane dye; a xanthine dye; a thiazine dye; a thiapyrylium dye; polyvinyl carbazole; and a bisbenzimidazole pigment.

One kind of those compounds can be used alone as the charge generating substance, or two or more kinds of them can be used in the form of a mixture as the charge generating substance.

Of those charge generating substances, substances described in JP 11-172003 A are suitable examples.

The binder resin in the above charge generating layer is not particularly limited, and any one of various resins can be used.

Specific examples of the binder resin include a polystyrene resin, a polyvinylchloride resin, a polyvinylacetate resin, a vinylchloride-vinylacetate copolymer, a polyvinylacetal resin, an alkyd resin, an acryl resin, a polyacrylonitrile resin, a polycarbonate resin, a polyamide resin, a butylal resin, a polyester resin, a vinylidenechloride-vinylchloride copolymer, a methacryl resin, a styrene-butadiene copolymer, a vinylidenechloride-acrylonitrile copolymer, a vinylchloride-vinylacetate-maleic anhydride copolymer, a silicone resin, a silicone-alkyd resin, a phenol-formaldehyde resin, a styrene-alkyd resin, a melamine resin, a polyether resin, a benzoguanamine resin, an epoxyacrylate resin, a urethaneacrylate resin, a poly-N-vinylcarbazole resin, a polyvinylbutylal resin, a polyvinylformal resin, a polysulfone resin, casein, gelatin, a polyvinyl alcohol resin, ethylcellulose, nitrocellulose, carboxy-methyl cellulose, vinylidenechloride-based polymer latex, an acrylonitrile-butadiene copolymer, a vinyltoluene-styrene copolymer, a soybean oil-modified alkyd resin, a nitrated polystyrene resin, apolymethylstyrene resin, apolyisoprene resin, a polythiocarbonate resin, a polyarylate resin, a polyhaloarylate resin, a polyaryl ether resin, a polyvinylacrylate resin, and polyesteracrylate resin.

A charge transporting layer can be formed by binding a charge transporting substance onto a layer as a ground (such as the charge generating layer) with a binder resin.

The binder resin in the above described charge transporting layer is not particularly limited, and any one of various resins can be used.

Specific examples of the binder resin include a polystyrene resin, a polyvinylchloride resin, a polyvinylacetate resin, a vinylchloride-vinylacetate copolymer, a polyvinylacetal resin, an alkyd resin, an acryl resin, a polyacrylonitrile resin, a polycarbonate resin, a polyamide resin, a butylal resin, a polyester resin, a vinylidenechloride-vinylchloride copolymer, a methacryl resin, a styrene-butadiene copolymer, a vinylidenechloride-acrylonitrile copolymer, a vinylchloride-vinylacetate-maleic anhydride copolymer, a silicone resin, a silicone-alkyd resin, a phenol-formaldehyde resin, a styrene-alkyd resin, a melamine resin, a polyether resin, a benzoguanamine resin, an epoxyacrylate resin, a urethaneacrylate resin, a poly-N-vinylcarbazole resin, a polyvinylbutylal resin, a polyvinylformal resin, a polysulfone resin, casein, gelatin, a polyvinyl alcohol resin, ethylcellulose, nitrocellulose, carboxy-methyl cellulose, vinylidenechloride-based polymer latex, an acrylonitrile-butadiene copolymer, a vinyltoluene-styrene copolymer, a soybean oil-modified alkyd resin, a nitrated polystyrene resin, apolymethylstyrene resin, apolyisoprene resin, a polythiocarbonate resin, a polyarylate resin, a polyhaloarylate resin, a polyaryl ether resin, a polyvinylacrylate resin, and polyesteracrylate resin.

One kind of the above described binder resins may be used alone, or two or more kinds of them may be used in combination.

Of the above described binder resins, a polycarbonate resin or a polyarylate resin is suitably used in the charge transporting layer in terms of, for example, mechanical characteristics, optical characteristics, electrical characteristics, and the ease with which the charge transporting layer is formed.

Any one of various modes can be employed as a method of forming the charge transporting layer; in ordinary cases, for example, a mode is employed, which involves applying an application liquid prepared by dispersing, in a proper solvent, the particles each having a double structure composed of a core member and a shell member having a larger rubber hardness than that of the core member of the present invention, the charge transporting substance, a polycarbonate resin or a polyarylate resin, and any other binder resin to be dispersed to such an extent that the object of the present invention is not impaired onto a predetermined substrate as a ground and drying the applied liquid.

In addition, a compounding ratio between a resin composition (mixture of the particles each having a double structure of the present invention and a binder resin) and the charge transporting substance is preferably 20:80 to 80:20, or more preferably 30:70 to 70:30 in mass ratio.

The charge transporting layer thus formed has a thickness of 5 to 100 μm, or preferably 10 to 30 μm.

When the thickness of the charge transporting layer is 5 μm or more, the initial potential of the electrophotographic photosensitive body increases. When the thickness is 100 μm or less, the electrophotographic characteristics of the electrophotographic photosensitive body are improved.

Any one of various compounds disclosed in JP2003-302775 A can be used as a charge transporting substance that can be used in the electrophotographic photosensitive body of the present invention.

Examples of those compound suitably used include a carbazole compound, an indole compound, an imidazole compound, an oxazole compound, a pyrazole compound, an oxadiazole compound, a pyrazoline compound, a thiadiazole compound, an aniline compound, a hydrazone compound, an aromatic amine compound, an aliphatic amine compound, a stilbene compound, a fluorenone compound, a butadiene compound, a quinone compound, a quinodimethane compound, a thiazole compound, a triazole compound, an imidazolone compound, an imidazolidine compound, bisimidazolidine compound, an oxazolone compound, a benzothiazole compound, a benzimidazole compound, a quinazoline compound, a benzofuran compound, an acridine compound, a phenazine compound, poly-N-vinylcarbazole, polyvinylpyrene, polyvinylanthracene, polyvinylacridine, poly-9-vinylphenylanthracene, a pyrene-formaldehyde resin, an ethylcarbazole resin, and a polymer having a structure of each compound at a main chain or a side chain.

One kind of those compounds may be used alone, or two or more kinds of them may be used.

In the electrophotographic photosensitive body of the present invention, an under layer can be provided between the above conductive base and the photosensitive layer.

As an under layer, there can be used: fine particles of titanium oxide, aluminum oxide, zirconia, titanic acid, zirconic acid, lanthanum lead, black titanium, silica, lead titanate, barium titanate, tin oxide, indium oxide, or silicon oxide; or a component of a polyamide resin, a phenol resin, casein, a melamine resin, a benzoguanamine resin, a polyurethane resin, an epoxy resin, cellulose, nitrocellulose, a polyvinylalcohol resin, or a polyvinylbutylal resin.

In addition, the above described binder resin may be used as a resin for use in the under layer.

One kind of those fine particles and resins can be used alone, or various kinds of them can be used as a mixture.

When those fine particles and resins are used as a mixture, inorganic fine particles and a resin are particularly suitably used in combination because a coating film having good smoothness can be formed.

The under layer has a thickness of 0.01 to 10 μm, or preferably 0.01 to 1 μm.

When the thickness is 0.01 μm or more, the under layer can be uniformly formed with ease. In addition, when the thickness is 10 μm or less, the electrophotographic characteristics of the electrophotographic photosensitive body are improved.

In addition, such blocking layer as ordinarily used can be provided between the above described conductive base and the photosensitive layer.

The same kind of a resin as that of the above described binder resin can be used in the blocking layer.

The blocking layer has a thickness of 0.01 to 20 μm, or preferably 0.01 to 10 μm.

When the thickness is 0.01 μm or more, the blocking layer can be uniformly formed with ease. In addition, when the thickness is 20 μm or less, the electrophotographic characteristics of the electrophotographic photosensitive body are improved.

Further, when a protective layer is laminated on the photosensitive layer in the electrophotographic photosensitive body of the present invention, the same kind of a resin as that of the above binder resin can be used in the protective layer.

The protective layer has a thickness of 0.01 to 20 μm, or preferably 0.01 to 10 μm.

In addition to the particles each having a double structure composed of a core member and a shell member having a larger rubber hardness than that of the core member of the present invention, the above described charge generating substance, the above described charge transporting substance, an additive, a metal or an oxide, nitride, salt, or alloy of the metal, carbon black, or a conductive material such as an organic conductive compound can be incorporated into the protective layer.

Further, a binding agent, a plasticizer, a curing catalyst, a fluidity imparting agent, a pinhole controlling agent, or a spectral sensitizer (sensitizing dye) may be added to each of the above described charge generating layer and the above described charge transporting layer in order that the performance of the electrophotographic photosensitive body of the present invention may be improved.

In addition, any one of the additives such as various chemical substances, antioxidants, surfactants, curl inhibitors, and leveling agents can be added to each of the layers with a view to preventing an increase in residual potential of the electrophotographic photosensitive body, and reductions in charged potential and sensitivity of the body due to the repeated use of the body.

Examples of the binder include a silicone resin, a polyamide resin, a polyurethane resin, a polyester resin, an epoxy resin, a polyketone resin, a polycarbonate resin, a polystyrene resin, a polymethacrylate resin, a polyacrylamide resin, a polybutadiene resin, a polyisoprene resin, a melamine resin, a benzoguanamine resin, a polychloroprene resin, a polyacrylonitrile resin, an ethylcellulose resin, a nitrocellulose resin, aurea resin, a phenol resin, a phenoxy resin, a polyvinylbutylal resin, a formal resin, a vinyl acetate resin, a vinyl acetate/vinyl chloride copolymer resin, and a polyester carbonate resin.

In addition, a heat curable resin and/or a photocurable resin can also be used.

Such resin is not particularly limited as long as the resin has electrical insulating property, and can be formed into a coating film in an ordinary state.

The binding agent is added at a compounding ratio of preferably 1 to 200 mass %, or more preferably 5 to 100 mass % with respect to the resin composition composed of the particles each having a double structure composed of a core member and a shell member having a larger rubber hardness than that of the core member and the binder resin of the charge transporting layer.

When the compounding ratio of the binding agent is 1 mass % or more, the following tendency is observed: the coating film of the photosensitive layer becomes uniform, and image quality is improved. When the compounding ratio is 200 mass % or less, the electrophotographic photosensitive body tends to have improved sensitivity and a reduced residual potential.

Specific examples of the plasticizer include biphenyl, biphenyl chloride, o-terphenyl, paraffin halide, dimethyl naphthalene, dimethyl phthalate, dibutyl phthalate, dioctyl phthalate, diethyleneglycol phthalate, triphenyl phosphate, diisobutyl adipate, dimethyl sebacate, dibutyl sebacate, butyl laurate, methylphtharylethyl glycolate, dimethylglycol phthalate, methyl naphthalene, benzophenone, polypropyrene, polystyrene, and fluoro hydrocarbon.

Specific examples of the above described curing catalyst include methanesulfonic acid, dodecylbenzenesulfonic acid, and dinonylnaphthalenedisulfonic acid. Specific examples of the fluidity imparting agent include a Modaflow and an Acronal 4F. Specific examples of the pinhole controlling agent include benzoin and dimethyl phthalate.

Each of the plasticizer, the curing catalyst, the fluidity imparting agent, and the pinhole controlling agent is preferably used at a content of 5 mass % or less with respect to the resin composition composed of the particles each having a double structure composed of a core member and a shell member having a larger rubber hardness than that of the core member and the binder resin of the above charge transporting layer.

In addition, when a sensitizing dye is used, suitable examples of the spectral sensitizer include: triphenylmethane-based dyes such as methyl violet, crystal violet, night blue, and Victoria blue; acridine dyes such as erythrosine, rhodamine B, rhodamine 3R, acridine orange, and flapeosine; thiazine dyes such as methylene blue andmethylene green; oxazinedyes such as capri blue and Meldola's blue; cyanine dyes; merocyanine dyes; styryl dyes; pyrylium salt dyes; and thiopyrylium salt dyes.

An electron accepting substance can be added to the photosensitive layer for the purposes of, for example, improving the sensitivity of the layer, reducing the residual potential of the layer, and reducing the fatigue of the layer due to the repeated use of the layer.

Specific examples of the electron acceptor substance preferably include compounds having large electron affinity such as succinic anhydride, maleic anhydride, dibromomaleic and hydride, phthalic anhydride, tetrachlorophtahalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picrylchloride, quinonechlorimide, chloranil, bromanil, benzoquinone, 2,3-dichlorobenzoquinone, dichlorodicyano p-benzoquinone, naphthoquinone, diphenoquinone, tropoquinone, anthraquinone, 1-chloroanthraquinone, dinitroanthraquinone, 4-nitrobenzophenone, 4,4'-dinitrobenzophenone, 4-nitrobenzalmalondinitrile, α-cyano-β-(p-cyanophenyl)ethyl acrylate, 9-anthracenylmethylmalondinitrile, 1-cyano-(p-nitrophenyl)-2-(p-chlorophenyl)ethylene, 2,7-dinitrofluorenone, 2,4,7-trinitrofluorenone, 2,4,5,7-tetranitrofluorenone, 9-fluorenylidene-(dicyanomethylenemalononitrile), polynitro-9-fluorenylidene-(dicyanomethylenemalonodinitrile), picric acid, o-nitrobenzoate, p-nitrobenzoate, 3,5-dinitrobenzoate, pentafluorobennzoate, 5-nitrosalicyalate, 3,5-dinitrosalicylate, phthalic acid, and mellitic acid.

Each of those compounds may be added to each of the charge generating layer and the charge transporting layer, and is added at a compounding ratio of 0.01 to 200 mass %, or preferably 0.1 to 50 mass % with respect to the charge generating substance or the charge transporting substance.

In addition, a tetrafluoroethylene resin, a trifluorochloroethylene resin, a tetrafluoroethylene-hexafluoropropylene resin, a vinyl fluoride resin, a vinylidene fluoride resin, or a difluorodichloroethylene resin, or a copolymer of two or more of them or a fluorine-based graft polymer of each of them may be used for improving the surface property of the electrophotographic photosensitive body.

Such surface modifier is added at a compounding ratio of 0.1 to 60 mass %, or preferably 2 to 40 mass % with respect to the resin composition composed of the particles each having a double structure composed of a core member and a shell member having a larger rubber hardness than that of the core member and the binder resin of the above described charge transporting layer.

When the compounding ratio is 0.1 mass % or more, a surface modifying effect such as an improvement in durability of the surface of the electrophotographic photosensitive body or a reduction in surface energy of the surface becomes sufficient. When the compounding ratio is 60 mass % or less, the electrophotographic characteristics of the electrophotographic photosensitive body are improved.

Preferable examples of the above described antioxidants include a hindered phenol-based antioxidant, an aromatic amine-based antioxidant, a hindered amine-based antioxidant, a sulfide-based antioxidant, and an organophosphorus antioxidant.

Such antioxidant is added at a compounding ratio of typically 0.01 to 10 mass %, or preferably 0.1 to 5 mass % with respect to the above described charge transporting substance or the resin composition composed of the particles each having a double structure composed of a core member and a shell member having a larger rubber hardness than that of the core member and the binder resin of the charge transporting layer.

Specific structural examples of the hindered phenol-based antioxidant, the aromatic amine-based antioxidant, the hindered amine-based antioxidant, the sulfide-based antioxidant, and the organophosphorus antioxidant include structures described in JP 11-172003 A.

One kind of those antioxidants may be used alone, or two or more kinds of them may be used as a mixture.

In addition, each of those antioxidants may be added to each of the protective layer, the under layer, and the blocking layer as well as the above described photosensitive layer.

Examples of a solvent for use in the formation of each of the above described charge generating layer and the above described charge transporting layer include: aromatic solvents such as benzene, toluene, xylene, chlorobenzene, and anisole; ketones such as acetone, methyl ethyl ketone, and cyclohexanone; alcohols such as methanol, ethanol, and isopropanol; esters such as ethyl acetate and ethyl cellosolve; halogen-based hydrocarbons such as carbon tetrachloride, chloroform, dichloromethane, and tetrachloroethane; ethers such as tetrahydrofuran and dioxane; dimethylformamide; and dimethyl sulfoxide.

One kind of those solvents may be used alone, or two or more kinds of them may be used as a mixed solvent.

An example of a method of preparing the above described application liquid is a method involving dispersing the above described raw materials with, for example, a ball mill, an ultrasonic wave, a paint shaker, a red devil, a sand mill, a mixer, or an attritor.

Examples of a method that can be adopted as a method of applying the resultant application liquid include an immersion coating method, an electrostatic coating method, a powder coating method, a spray coating method, a roll coating method, an applicator coating method, a spray coater coating method, a bar coater coating method, a roll coater coating method, a dip coater coating method, a doctor blade coating method, a wire bar coating method, a knife coater coating method, an attritor coating method, a spinner coating method, a bead coating method, a blade coating method, and a curtain coating method.

The photosensitive layer of a monolayer electrophotographic photosensitive body is formed by using, for example, a resin composition composed of the particles each having a double structure composed of a core member and a shell member having a larger rubber hardness than that of the core member of the present invention and a binder resin, a charge generating substance, a charge transporting substance (at least one of a hole transporting substance and an electron transporting substance), an additive, and any other binder resin.

A method of preparing an application liquid, a method of applying the liquid, the additive, and the like in this case are similar to those in the case of the formation of the photosensitive layer of the above described laminated electrophotographic photosensitive body.

Further, even in the monolayer electrophotographic photosensitive body, an under layer, a blocking layer, or a protective layer may be provided as in the case of the foregoing.

The photosensitive layer in the monolayer electrophotographic photosensitive body has a thickness of 5 to 100 μm, or preferably 8 to 50 μm. When the thickness of the photosensitive layer is 5 μm or more, the initial potential of the electrophotographic photosensitive body can be set to a desired value. When the thickness is 100 μm or less, the electrophotographic characteristics of the electrophotographic photosensitive body are improved.

A ratio between the charge generating substance and the resin composition (mixture of the particles each having a double structure according to the present invention and the binder resin) for use in the production of the monolayer electrophotographic photosensitive body is 1:99 to 30:70, or preferably 3:97 to 15:85 in mass ratio.

In addition, when a charge transporting substance is added, a ratio between the charge transporting substance and the resin composition (mixture of the particles each having a double structure according to the present invention and the binder resin) is 5:95 to 80:20, or preferably 10:90 to 60:40 in mass ratio.

The electrophotographic photosensitive body of the present invention thus obtained is a photosensitive body having excellent wear resistance and having excellent scratch resistance and excellent electrophotographic characteristics for a long time period, and suitably finds use in a variety of electrophotographic fields such as copying machines (monochromatic, multi-color, or full-color; analog or digital copying machines), printers (laser, LED, or liquid crystal shutter printers), facsimiles, and plate makers.

Upon use of the electrophotographic photosensitive body of the present invention, corona discharge (corotron or scorotron), contact charging (charging roll or charging brush), or the like is employed as a charging method.

In addition, any one of a halogen lamp, a fluorescent lamp, laser (semiconductor laser or He—Ne laser), an LED, and a photosensitive body internal exposure mode may be adopted as exposing means.

A dry developing mode such as cascade development, two-component magnetic brush development, one-component insulating toner development, or one-component conductive toner development, or a wet developing mode involving the use of, for example, liquid toner is employed as a developing method.

An electrostatic transferring method such as corona transfer, roller transfer, or belt transfer, a pressure transferring method, or an adhesive transferring method is employed as a transferring method.

Heat roller fixing, radiant flash fixing, open fixing, pressure fixing, or the like is employed as a fixing method.

Further, a brush cleaner, a magnetic brush cleaner, a magnetic roller cleaner, a blade cleaner, or the like is used as means for cleaning and an antistatic treatment.

EXAMPLES

Next, the present invention will be described in more detail by way of examples and comparative examples. However, the present invention is by no means limited by these examples.

Production Example 1

Melamine-formaldehyde Resin Microcapsule Including Oil

The pH of 100 g of a 5-mass % aqueous solution of an ethylene-maleic anhydride copolymer (manufactured by Monsanto Company, EMI-31) as an anionic water-soluble polymer substance was adjusted to 4.5. After that, 100 ml of mineral oil [ISOVG150, dynamic viscosity center value 150 $mm^2/s$ (40° C.)] as a fluid were added to, and emulsified and dispersed with a homomixer in, the solution, whereby an O/W type emulsion containing oil droplets each having a particle diameter of 2 to 3 μm was obtained.

Seventy gram of a solution prepared by adjusting the solid content of an aqueous solution of a methylol-melamine resin (manufactured by Sumito Chemical Co., Ltd., SUMIREZ RESIN 613) to 17 mass % were added to the emulsion system while the system was stirred. Further, the temperature of the system was increased to 55° C., and the system was continuously stirred for about 2 hours. After that, a 15-mass % aqueous solution of sodium hydroxide was added to the system to adjust the pH of the system to 5.5, and the whole was continuously stirred for an additional 3 hours.

The temperature of the system was slowly cooled to room temperature, whereby a capsule resin coating film (primary resin coating film) was formed on an interface between an oil droplet and water.

Next, the pH of the system as microcapsule slurry was reduced to 3.5 with 10-mass % hydrochloric acid. Then, 100 g of a 25-mass % aqueous solution of a methylol-melamine resin were added to the slurry, and the whole was continuously stirred with the temperature of the system increased to 50° C.

After that, the pH of the system was increased by 0.2, the temperature of the system was increased to 60° C., and the system was stirred for 2 hours while the speed at which the system was stirred was adjusted. Thus, a concentrated polymerized melamine resin capturing a precipitated fine piece was deposited as a secondary resin coating film on the primary coating film surface of each microcapsule particle.

About 100 ml of water were added to the system to cool the system to room temperature, and the resultant microcapsule dispersion (slurry) was dewatered by vacuum aspiration with a Buchner funnel. As a result, the microcapsule particles were turned into a cake shape.

The dewatering cake was spread on a tray and left standing at room temperature for 24 hours. After that, the cake was subjected to a sieve vibrator with a 400-mesh screen. As a result, the dry block was easily disentangled, and the resultant particles passed as primary particles through the mesh, whereby a microcapsule (MC-1) powder was obtained.

The resultant microcapsules had an average particle diameter of 5 μm.

It should be noted that a melamine-formaldehyde resin is a resin that does not show rubber elasticity.

Example 1

An electrophotographic photosensitive body was produced by sequentially laminating a charge generating layer and a charge transporting layer on the surface of a polyethylene terephthalate resin film onto which an aluminum metal had been deposited from the vapor, the film being used as a conductive base, to form a laminated photosensitive layer.

0.5 part by mass of oxotitanium phthalocyanine was used as a charge generating substance, and 0.5 part by mass of a butyral resin was used as a binder resin.

The charge generating substance and the binder resin were added to, and dispersed with a ball mill in, 19 parts by mass of methylene chloride as a solvent. The dispersion was applied to the surface of the above conductive base film with a bar coater, and was dried, whereby a charge generating layer having a thickness of about 0.5 μm was formed.

Next, 0.5 g of a compound (CTM-1) represented by the following structural formula as a charge transporting substance, 0.5 g of a polycarbonate resin [PC-1: 1,1-bis(4-hydroxyphenyl)cyclohexane polycarbonate, viscosity average molecular weight=50,000], and 50 mg of a silicone composite powder (manufactured by Shin-Etsu Silicones, KMP-600, fine particles obtained by coating a silicone rubber powder with a silicone resin, average particle diameter 5 μm, total rubber hardness Shore A30) were dispersed in 10 ml of tetrahydrofuran, whereby an application liquid was prepared.

CTM-1

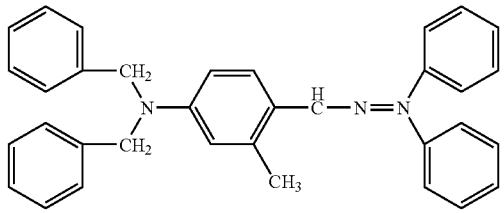

The application liquid was applied onto the above charge generating layer with an applicator, and was dried, whereby a charge transporting layer having a thickness of about 20 μm was formed.

The manner in which the silicone composite powder was dispersed in the applied liquid or applied film in this case was observed, and the powder was evaluated for dispersibility as described below.

The powder does not agglomerate: the dispersibility is good (○), the powder is observed to agglomerate: the dispersibility is bad (X).

Next, the following electrophotographic characteristics of the electrophotographic photosensitive body were measured with a static electricity charging testing device EPA-8100 [manufactured by Kawaguchi Electric Works Co., Ltd.].

Corona discharge at −6 kV was performed, the initial surface potential (V0), residual potential (VR) after irradiation with light (10 Lux) for 5 seconds, and half decay exposure (E½) of the electrophotographic photosensitive body were measured, and the body was evaluated as described below.

The surface potential falls within the range of −740 V to −770 V: good (○), the surface potential deviates from the range: bad (X).

The residual potential falls within the range of 0 V to −10 V: good (○), the residual potential deviates from the range: bad (X).

The half decay exposure is 0.85 Lux-sec or less: good (○), the half decay exposure exceeds 0.85 Lux-sec: bad (X).

Further, abrasive paper (containing alumina particles each having a particle diameter of 3 μm) to which a load of 4.9 N was applied was brought into contact with the surface of the photosensitive layer, and was reciprocated 2,000 times by using a SUGA abrasion testing machine NUS-ISO-3 type [manufactured by SUGA TEST INSTRUMENTS]. Then, the amount in which the mass of the photosensitive layer reduced was measured, and the charge transporting layer was evaluated for wear resistance.

Further, the coefficient of dynamic friction of the same sample as that evaluated for wear resistance was measured with a surface property testing machine [manufactured by HEIDON, load 20 g, rate 20 mm/min, abrasive body: stainless sphere].

Table 1 shows those results.

Example 2

A photosensitive body was produced in the same manner as in Example 1 except that the polycarbonate resin (PC-1) of Example 1 was changed to a polycarbonate resin [PC-2: 2,2-bis(3-methyl-4-hydroxyphenyl)propane polycarbonate, viscosity average molecular weight=50,000], and the body was evaluated for dispersibility and electrophotographic characteristics in the same manner as in Example 1.

Table 1 shows those results.

Example 3

A photosensitive body was produced in the same manner as in Example 1 except that the polycarbonate resin (PC-1) of Example 1 was changed to a polycarbonate resin [PC-3: a 1:1 copolymerized polycarbonate of 2,2-bis(3-methyl-4-hydroxyphenyl)propane and 1,1-bis(4-hydroxyphenyl)-1-phenylethane, viscosity average molecular weight=50,000], and the body was evaluated for dispersibility and electrophotographic characteristics in the same manner as in Example 1.

Table 1 shows those results.

Example 4

A photosensitive body was produced in the same manner as in Example 1 except that the polycarbonate resin (PC-1) of Example 1 was changed to a polycarbonate resin [PC-4: a 2:6:2 copolymerized polycarbonate of 2,2-bis(3-methyl-4-hydroxyphenyl)propane, 2,2-bis(4-hydroxyphenyl)propane and 1-1-bis(4-hydroxyphenyl)-1-phenylethane, viscosity average molecular weight=50,000], and the body was evaluated for dispersibility and electrophotographic characteristics in the same manner as in Example 1.

Table 1 shows those results.

Example 5

A photosensitive body was produced in the same manner as in Example 1 except that the polycarbonate resin (PC-1) of Example 1 was changed to a polycarbonate resin [PC-5: a 3:7 copolymerized polycarbonate of 2,2-bis(3-methyl-4-hydroxyphenyl)propane and 2,2-bis(4-hydroxyphenyl)propane, viscosity average molecular weight=50,000], and the body was evaluated for dispersibility and electrophotographic characteristics in the same manner as in Example 1.

Table 1 shows those results.

Example 6

A photosensitive body was produced in the same manner as in Example 1 except that the polycarbonate resin (PC-1) of Example 1 was changed to a polycarbonate resin [PC-6: an 8:2 copolymerized polycarbonate of 1,1-bis(4-hydroxyphenyl)cyclohexane and 4,4'-biphenol, viscosity average molecular weight=50,000], and the body was evaluated for dispersibility and electrophotographic characteristics in the same manner as in Example 1.

Table 1 shows those results.

Example 7

A photosensitive body was produced in the same manner as in Example 1 except that the polycarbonate resin (PC-1) of Example 1 was changed to a polycarbonate resin [PC-7: an 8:2 copolymerized polycarbonate of 2,2-bis(4-hydroxyphenyl)propane and 4,4'-biphenol, viscosity average molecular weight=50,000], and the body was evaluated for dispersibility and electrophotographic characteristics in the same manner as in Example 1.

Table 1 shows those results.

Example 8

A photosensitive body was produced in the same manner as in Example 1 except that the polycarbonate resin (PC-1) of Example 1 was changed to a polycarbonate resin [PC-8: an 8:2:0.01 copolymerized polycarbonate of 2,2-bis(4-hydroxyphenyl)propane, 4,4'-biphenol, and α,ω-bis[3-(2-hydroxyphenyl)propanedimethylsiloxy]polydimethylsiloxane (number average molecular weight: 3,000), viscosity average molecular weight=50,000], and the body was evaluated for dispersibility and electrophotographic characteristics in the same manner as in Example 1.

Table 1 shows those results.

Example 9

A photosensitive body was produced in the same manner as in Example 1 except that the polycarbonate resin (PC-1) of Example 1 was changed to a polycarbonate resin [PC-9: an 8:2:0.3 copolymerized polycarbonate of 2,2-bis(4-hydroxyphenyl)propane, 4,4'-biphenol, and α,ω-bis[3-(3-methoxy-4-hydroxyphenyl)propanedimethylsiloxy]polydimethylsiloxane (number average molecular weight: 3,000), viscosity average molecular weight=50,000], and the body was evaluated for dispersibility and electrophotographic characteristics in the same manner as in Example 1.

Table 1 shows those results.

Example 10

A photosensitive body was produced in the same manner as in Example 1 except that the polycarbonate resin (PC-1) of Example 1 was changed to a polycarbonate resin [PC-10: an 8:2 copolymerized polycarbonate of 2,2-bis(4-hydroxyphenyl)butane and 9,9-bis(3-methyl-4-hydroxyphenyl)fluorene, viscosity average molecular weight=50,000], and the body was evaluated for dispersibility and electrophotographic characteristics in the same manner as in Example 1.

Table 1 shows those results.

Example 11

A photosensitive body was produced in the same manner as in Example 1 except that the polycarbonate resin (PC-1) of Example 1 was changed to a polycarbonate resin [PC-11: an 8:2 copolymerized polycarbonate of 1,1-bis(4-hydroxyphenyl)ethane and 4,4'-biphenol, viscosity average molecular weight=50,000], and the body was evaluated for dispersibility and electrophotographic characteristics in the same manner as in Example 1.

Table 1 shows those results.

Example 12

A photosensitive body was produced in the same manner as in Example 1 except that the polycarbonate resin (PC-1) of Example 1 was changed to a polycarbonate resin [PC-12: an 8:2:0.03 copolymerized polycarbonate of 1,1-bis(4-hydroxyphenyl)ethane, 9,9-bis(3-methyl-4-hydroxyphenyl)fluorene, and α,ω-bis[3-(3-methoxy-4-hydroxyphenyl)propanedimethylsiloxy]polydimethylsiloxane (number average molecular weight: 3,000), viscosity average molecular weight=70,000], and the body was evaluated for dispersibility and electrophotographic characteristics in the same manner as in Example 1.

Table 1 shows those results.

Example 13

A photosensitive body was produced in the same manner as in Example 1 except that the polycarbonate resin (PC-1) of Example 1 was changed to a polyarylate resin [PAR-1: a 50:25:50 copolymerized polyarylene of 2,2-bis(3-methyl-4-hydroxyphenyl)propane, terephthalic acid, and isophthalic acid, viscosity average molecular weight=50,000], and the body was evaluated for dispersibility and electrophotographic characteristics in the same manner as in Example 1.

Table 1 shows those results.

Example 14

A photosensitive body was produced in the same manner as in Example 1 except that the silicone composite powder of Example 1 (manufactured by Shin-Etsu Silicones, KMP-600, fine particles obtained by coating a silicone rubber powder with a silicone resin, average particle diameter 5 μm, total rubber hardness Shore A30) was changed to a silicone composite powder (manufactured by Shin-Etsu Silicones, KMP-605, fine particles obtained by coating a silicone rubber powder with a silicone resin, average particle diameter 2 μm, total rubber hardness Shore A75), and the body was evaluated for dispersibility and electrophotographic characteristics in the same manner as in Example 1.

Table 1 shows those results.

Example 15

A photosensitive body was produced in the same manner as in Example 1 except that the silicone composite powder of Example 1 (manufactured by Shin-Etsu Silicones, KMP-600, fine particles obtained by coating a silicone rubber powder with a silicone resin, average particle diameter 5 μm, total rubber hardness Shore A30) was changed to a microcapsule (MC-1) of Production Example 1, and the body was evaluated for dispersibility and electrophotographic characteristics in the same manner as in Example 1.

Table 1 shows those results.

TABLE 1

| | Initial surface potential (V) | Residual potential (V) | Sensitivity (half decay exposure) (Lux · sec) | Amount in which photosensitive layer wears (mg) | Coefficient of dynamic friction | Dispersibility |
|---|---|---|---|---|---|---|
| Example 1 | ○ | ○ | ○ | 0.8 | 0.5 | ○ |
| Example 2 | ○ | ○ | ○ | 1.0 | 0.5 | ○ |
| Example 3 | ○ | ○ | ○ | 1.1 | 0.5 | ○ |
| Example 4 | ○ | ○ | ○ | 1.3 | 0.5 | ○ |
| Example 5 | ○ | ○ | ○ | 1.2 | 0.5 | ○ |
| Example 6 | ○ | ○ | ○ | 0.5 | 0.5 | ○ |
| Example 7 | ○ | ○ | ○ | 0.7 | 0.5 | ○ |
| Example 8 | ○ | ○ | ○ | 0.6 | 0.5 | ○ |
| Example 9 | ○ | ○ | ○ | 0.6 | 0.5 | ○ |
| Example 10 | ○ | ○ | ○ | 0.8 | 0.5 | ○ |
| Example 11 | ○ | ○ | ○ | 0.4 | 0.5 | ○ |
| Example 12 | ○ | ○ | ○ | 0.8 | 0.5 | ○ |
| Example 13 | ○ | ○ | ○ | 0.8 | 0.5 | ○ |
| Example 14 | ○ | ○ | ○ | 1.0 | 0.6 | ○ |
| Example 15 | ○ | ○ | ○ | 0.9 | 0.6 | ○ |

Comparative Examples 1 to 13

Photosensitive bodies were each produced in the same manner as in Example 1 except that the particles each having a double structure were not added in each of Examples 1 to 13, and the bodies were each evaluated for dispersibility and electrophotographic characteristics in the same manner as in Example 1. Table 2 shows those results.

Comparative Example 14

A photosensitive body was produced in the same manner as in Example 1 except that the silicone composite powder of Example 1 (manufactured by Shin-Etsu Silicones, KMP-600, fine particles obtained by coating a silicone rubber powder with a silicone resin, average particle diameter 5 μm, total rubber hardness Shore A30) was changed to methyl silicone particles (manufactured by Dow Corning Toray Co., Ltd., Trefil E-500, average particle diameter 3 μm, total rubber hardness Shore A30), and the body was evaluated for dispersibility and electrophotographic characteristics in the same manner as in Example 1.

Table 2 shows those results.

TABLE 2

| | Initial surface potential (V) | Residual potential (V) | Sensitivity (half decay exposure) (Lux · sec) | Amount in which photosensitive layer wears (mg) | Coefficient of dynamic friction | Dispersi-bility |
|---|---|---|---|---|---|---|
| Comparative Example 1 | ○ | ○ | ○ | 1.9 | 0.7 | — |
| Comparative Example 2 | ○ | ○ | ○ | 1.9 | 0.7 | — |
| Comparative Example 3 | ○ | ○ | ○ | 2.1 | 0.7 | — |
| Comparative Example 4 | ○ | ○ | ○ | 2.1 | 0.7 | — |
| Comparative Example 5 | ○ | ○ | ○ | 2.1 | 0.7 | — |
| Comparative Example 6 | ○ | ○ | ○ | 1.5 | 0.7 | — |
| Comparative Example 7 | ○ | ○ | ○ | 1.8 | 0.7 | — |
| Comparative Example 8 | ○ | ○ | ○ | 2.0 | 0.7 | — |
| Comparative Example 9 | ○ | ○ | ○ | 1.9 | 0.7 | — |
| Comparative Example 10 | ○ | ○ | ○ | 1.7 | 0.7 | — |
| Comparative Example 11 | ○ | ○ | ○ | 1.5 | 0.7 | — |
| Comparative Example 12 | ○ | ○ | ○ | 1.7 | 0.7 | — |
| Comparative Example 13 | ○ | ○ | ○ | 1.8 | 0.7 | — |
| Comparative Example 14 | ○ | ○ | ○ | 1.1 | 0.3 | X |

INDUSTRIAL APPLICABILITY

According to the present invention, an electrophotographic photosensitive body which: has improved mechanical strength such as wear resistance; and maintains low surface energy (coefficient of friction) with which high durability and high cleaning property can be realized can be provided by dispersing particles each having a double structure composed of a core member and a shell member having a larger rubber hardness than that of the core member in the outermost layer (such as the photosensitive layer) of the electrophotographic photosensitive body.

The invention claimed is:

1. An electrophotographic photosensitive body having a photosensitive layer on a conductive base, at least an outermost layer of the electrophotographic photosensitive body containing particles each having a double structure composed of a core member and a shell member, the shell member having a larger rubber hardness than that of the core member, wherein the particles each having a double structure comprise particles each obtained by coating a rubber spherical particle having a rubber hardness of Shore A50 or less with a resin having a rubber hardness of more than Shore A50, the rubber spherical particle being made of a silicone rubber, and the resin comprising a silicone resin, or microcapsules having a rubber hardness more than Shore A50 each including a fluid, and the fluid comprises a mineral oil, and the shell member of each of the microcapsules comprises a melamine-formaldehyde resin.

2. An electrophotographic photosensitive body according to claim 1, wherein the outermost layer contains the particles each having a double structure at a content of 1 to 30 mass % with respect to a total amount of a binder resin, and other functional materials or a material for a protective layer.

3. An electrophotographic photosensitive body according to claim 1, wherein the particles each having a double structure have an average particle diameter of 10 μm or less.

* * * * *